US006971242B2

(12) United States Patent
Boardman

(10) Patent No.: US 6,971,242 B2
(45) Date of Patent: Dec. 6, 2005

(54) BURNER FOR A GAS TURBINE ENGINE

(75) Inventor: Gregory A. Boardman, Columbus, IN (US)

(73) Assignee: Caterpillar Inc., Peoria, IL (US)

( * ) Notice: Subject to any disclaimer, the term of this patent is extended or adjusted under 35 U.S.C. 154(b) by 34 days.

(21) Appl. No.: 10/791,490

(22) Filed: Mar. 2, 2004

(65) Prior Publication Data

US 2005/0198966 A1 Sep. 15, 2005

(51) Int. Cl.[7] ..... F23R 3/16
(52) U.S. Cl. ..... 60/776; 60/738
(58) Field of Search ..... 60/737, 738, 752, 60/754, 772, 776

(56) References Cited

U.S. PATENT DOCUMENTS 2,654,219 A * 10/1953 Zaba ..... 60/752
3,890,088 A 6/1975 Ferri
5,660,045 A 8/1997 Ito et al.
6,314,716 B1 11/2001 Abreu et al.
6,330,791 B1 12/2001 Kendall et al.
6,684,641 B2 * 2/2004 Moriya et al. ..... 60/737
2002/0148226 A1 10/2002 Kendall et al.

* cited by examiner

*Primary Examiner*—Ehud Gartenberg

(57) ABSTRACT

To meet emissions standards, many gas turbine engines use some form of lean, pre-mixed combustion systems. These systems may lead to combustion oscillations or other instabilities. Jet combustion techniques provide a stable alternative lean, pre-mixed combustion system. The present invention presents a jet combustion system that includes a first cylinder having a first array of orifices. A second cylinder is positioned coaxially with the first cylinder. The second cylinder has a second array of orifices offset from the first array of orifices.

20 Claims, 3 Drawing Sheets

BURNER FOR A GAS TURBINE ENGINE

TECHNICAL FIELD

The present invention is directed to an apparatus and method for burning a mixture of fuel and air. More particularly, the present invention is directed to an apparatus and method for burning a mixture of fuel and air in a gas turbine engine.

BACKGROUND

Producers of gas turbine engines have made great strides in reducing regulated emissions such as NOx through a number of methods including lean, pre-mixed combustion systems (discussed in U.S. Pat. No. 5,660,045 issued to Ito et al. on 26 Aug. 1997) wherein a mass of fuel and a mass of air mix prior to ignition. The mass of air in such a system substantially exceeds the stoichiometric mass of air needed to chemically react with the mass of fuel. Further increasing the mass of air flowing through such a system may increase the NOx reduction by further reducing a primary combustion zone temperature. NOx emissions generally form when an excess of oxygen reacts with nitrogen at elevated temperatures. However, increasing the mass of air may also lead to instabilities in combustion.

Adding additional air also assumes availability of additional air. Lean, pre-mixed combustion may still require at least a portion of a mass of air exiting a compressor of the gas turbine for use in cooling a combustion liner surrounding the primary combustion zone. This requirement limits the mass of air available for pre-mixing. Alternative cooling schemes may allow the mass of air to be used both for cooling the combustion liner and for pre-mixing with fuel (U.S. Pat. No. 6,314,716 issued to Abreu et al. on 13 Nov. 2001). These systems may require additional control mechanisms necessary to maintain a desired distribution of air for cooling and pre-mixing.

An alternative combustion design suggests using a radiant surface burner (U.S. Pat. No. 6,330,791 issued to Kendall et al. on 18 Dec. 2001). Radiant burners provide a compact design that allows pre-mixing of fuel and air similar to lean, pre-mixed combustion systems. Past radiant burners have used a porous ceramic structure or fibrous mat made of either ceramic or metallic material. These materials have a tendency to accumulate various particles eventually leading to partial blocking of portions of the porosities.

The apparatus and method of the present invention solves one or more of the problems set forth above.

SUMMARY OF THE INVENTION

The present application discloses a fuel burner for a gas turbine engine including a first cylinder having a first array of orifices. A second cylinder having a second array of orifices is coaxial with the first cylinder. The first array of orifices is offset from the second array of orifices.

In addition, the application describes a method of burning a fuel in a gas turbine engine. The method includes supplying a mixture of fuel and air to a first cylinder, flowing said mixture of fuel and air through a first array of orifices in said first cylinder, reducing a pressure of said mixture of fuel and air, impinging a second cylinder with said mixture of fuel and air, transferring heat from said second cylinder to said mixture of fuel and air during said impinging, mixing further said mixture of fuel and air after said transferring, passing said mixture of fuel and air through a second array of orifices in said second cylinder, and igniting said mixture of fuel and air.

In addition, the application also describes a method of cooling a fuel burner for a gas turbine engine. The method includes supplying a mixture of fuel and air to a first cylinder, circulating said mixture of fuel and air with a circulating device in said first cylinder, flowing said mixture of fuel and air through at least one orifice of said circulating device, flowing said mixture of fuel and air through a first array of orifices in said first cylinder, impinging a second cylinder with said mixture of fuel and air; and transferring heat from said second cylinder to said mixture of fuel and air during said impinging.

DETAILED DESCRIPTION

Figure 1:
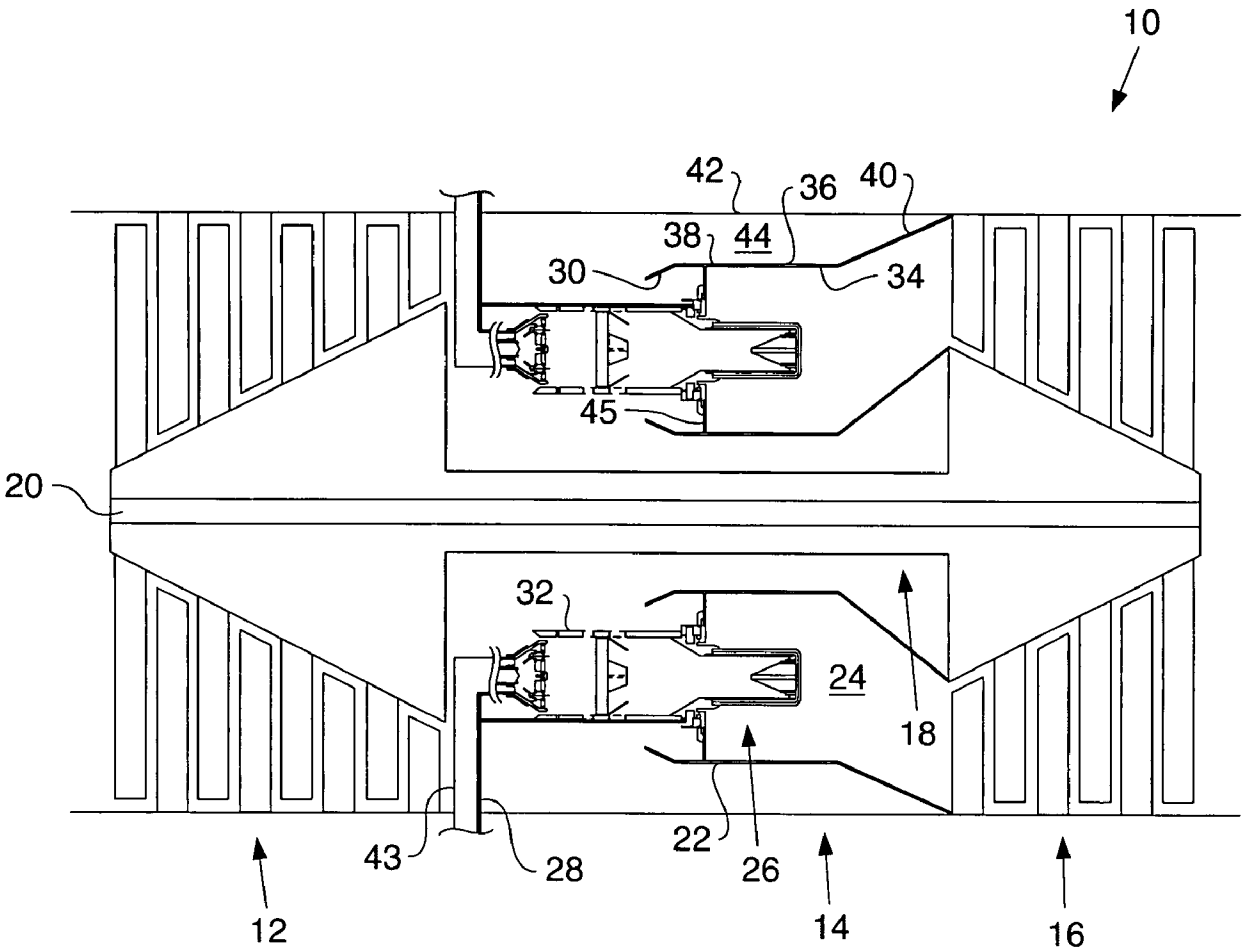
FIG. 1 is a schematic representation of a gas turbine engine including an exemplary embodiment of the present invention.

FIG. 1 shows a gas turbine engine 10 including a compressor section 12, a combustion system 14, and a turbine section 16. The compressor section 12 fluidly connects with the combustion system 14 to supply a compressed mass of air (not shown) to the combustion system 14. The turbine section 16 fluidly connects with the combustion system 14 and receives a mass of exhaust gas (not shown) from the combustion system 14. The mass of exhaust gas expands through the turbine section 16. The compressor section 12 and turbine section 16 connect through a force transmitting means 18 between the turbine section 16 and compressor section 12. In the present embodiment, the force transmitting means 18 is shown as a shaft 20. Other conventional methods for transmitting a force may include a hydraulic accumulator/motor, electric motor/generator, and gear systems.

The combustion system 14 as shown in FIG. 1 may include a combustor liner 22, a fuel burner 26, a fuel supply line 28, a dome 30, and a mixing conduit 32. The combustion system 14 while shown in an annular configuration may be of any conventional configurations such as can-annular or can. The combustor liner 22 has a hot side 34, a cold side 36, a first portion 38, and a second portion 40. The hot side 34 defines a combustion zone 24. The cold side 36 along with a casing 42 defines an air channel 44. The dome 30 may attach to the hot side 34 proximate the first portion 38. A grommet 45 may separate the fuel burner 26 from the dome 30. The mixing conduit 32 is in fluid communication with the fuel burner 26. The fuel supply line 28 may introduce a fuel (not shown) into the mixing conduit 32. A second fuel supply line 43 may provide a second fuel (not shown) into the mixing conduit 32. The combustor liner 22 may include any conventional manner of augmentation cooling devices (not shown) on the cold side 36 such as trip strips, dimples, or designs allowing for impingement cooling.

Figure 2:
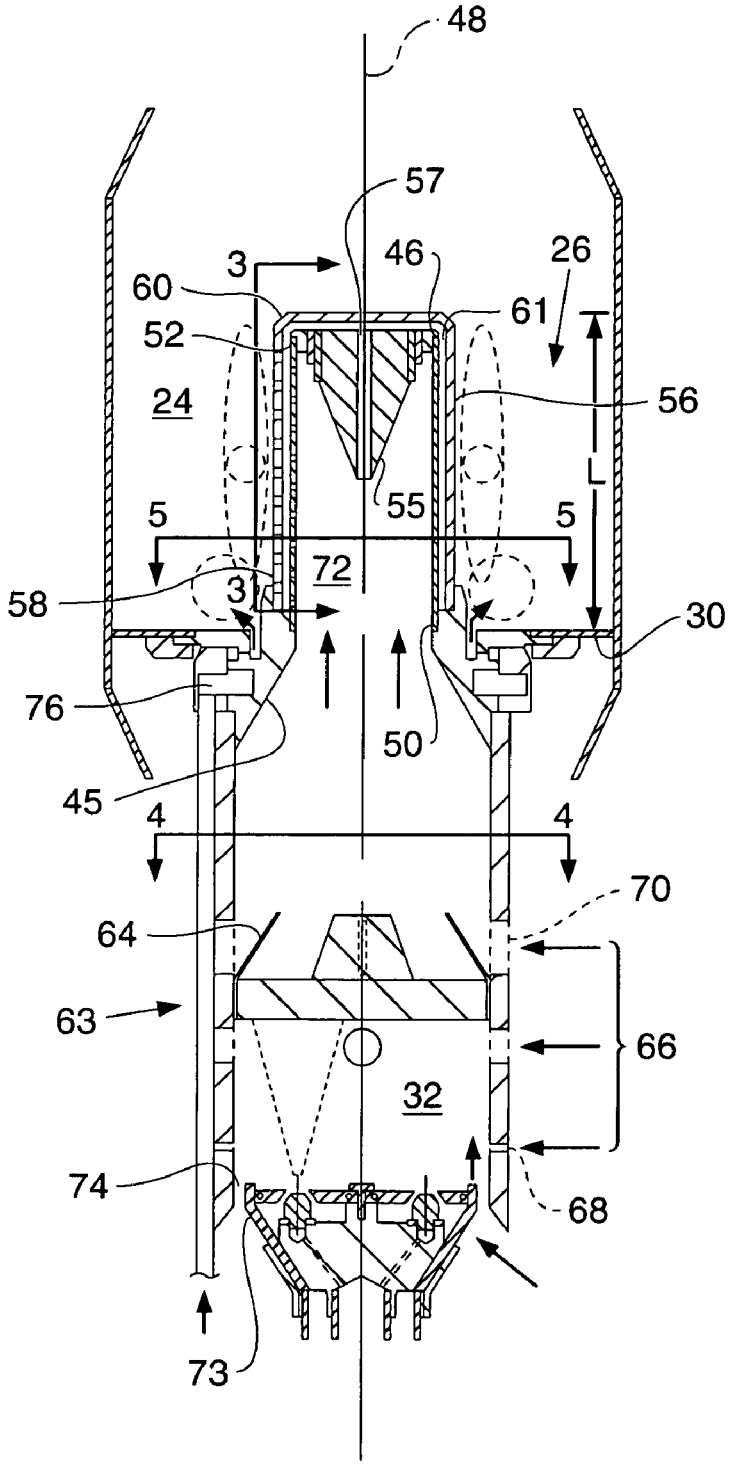
FIG. 2 is a diagrammatic view of a combustion system for the gas turbine engine with an exemplary embodiment of the present invention.
Figure 3:
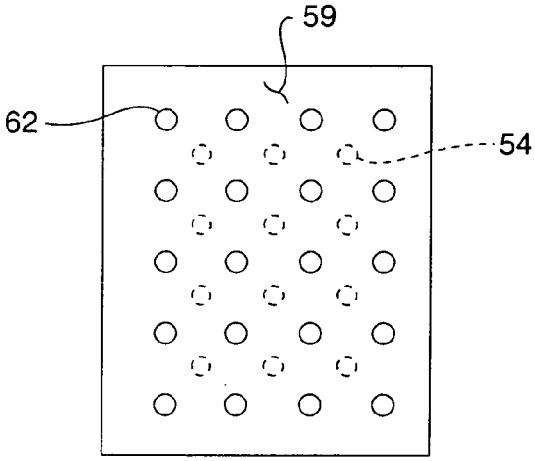
FIG. 3 is a plan view of a portion of fuel burner in the combustion system through FIG. 3—3.

As shown in FIGS. 2 and 3, the fuel burner 26 includes a first cylinder 46 about a central axis 48. The first cylinder 46 has a first end portion 50 and a second end portion 52. The first end portion 50 may attach to the grommet 45. A first array of orifices 54 extend between the first end portion 50 and second end portion 52. The first array of orifices may extend a length L or only some portion thereof. Any conventional forming method may create the first cylinder 46 and associated orifices 54 such as machining, casting, or forging. The first array of orifices 54 may include orifices of different diameters such as increasing or decreasing the orifice diameters as a function of an axial position along the central axis 48. In the present application, the term cylinder means a vessel having a volume that may at least partially bound a fluid and may have an irregular shaped profile other than a rectangle. A circulating device 55 may be positioned within the first cylinder 46 for circulating the mixture of fuel and air. As shown, the circulating device is a perforated cone positioned proximate the second end portion 52 of the first cylinder 46, however, it should be appreciated to one of ordinary skill in the art that any similar structure for circulating the mixture of fuel and air adjacent the second end portion 52 may be used. The circulating device 55 may include an orifice 57 extending through the circulating device 55. However, it should be appreciated to one skilled in the art that a plurality of orifices associated with the circulating device may be used.

Similarly, a second cylinder 56 is concentric with and displaced radially from the first cylinder 46. The second cylinder 56 generally has a larger circumference than the first cylinder 46 at any given point along the central axis 48. The second cylinder 56 has a first end portion 58 connecting with the grommet 45 and a second end portion 60 adjacent the second end portion 52 of the first cylinder 46. The second cylinder includes a solid portion 59 defining a second array of orifices 62 extending between the first end portion 58 and the second end portion 60. Any conventional method may be used to create the second cylinder 56 including machining, casting, or forging. In addition, the second cylinder 56 may be made of any material able to withstand temperatures exhibited in a combustion environment such as a ceramic, nickel alloys, or materials coated with a thermal barrier coating. Like the first cylinder 46, the second array of orifices 62 may have hole diameters that vary as a function of location along the central axis 48. The diameter of the second cylinder 56 may also vary along the central axis 48.

The first array of orifices 54 and second array of orifices 62 are offset from one another. In the present application offset means that any single orifice from the first array of orifices 54 will not overlap any single orifice from the second array of orifices 62 as shown specifically in FIG. 3. The offset may be accomplished by offsetting the arrays axially about the central axis, tangentially about the central axis, or both as shown in FIG. 3. Orifice diameters in the second array of orifices 62 will generally be larger than orifice diameters in the first array of orifices 54. A gap or annular region 61 is defined by some radial distance (not shown) between the first cylinder 46 and second cylinder 56.

Figure 4:
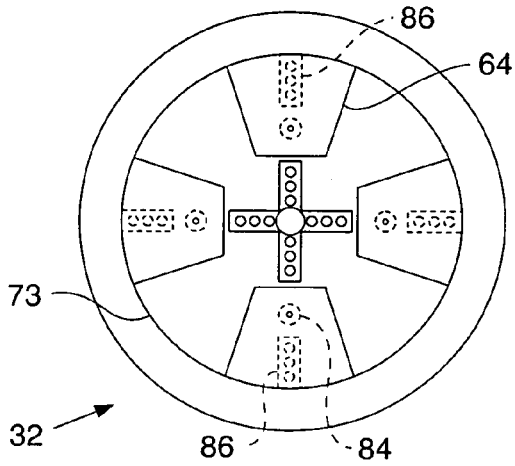
FIG. 4 is a sectional view of the combustion system through line 4—4 of FIG. 2.

The mixing conduit 32, as best shown in FIGS. 2 and 4, may attach to the grommet 45 opposite the first cylinder 46 and second cylinder 56. The mixing conduit 32 may include a fluid mixing means 63 for mixing the fuel with the mass of compressed air. In the present embodiment the fluid mixing means may include a plurality of vortex generator tabs 64. The fluid mixing means 63 also may include introducing a portion of the mass of compressed air through an array of mixing orifices 66 positioned along the mixing conduit 32 upstream of the dome 30. The array of mixing orifices 66 may include offset mixing orifices 68 positioned upstream of the vortex generator tabs 64 and vortex energizing slots 70 downstream of the vortex generator tabs 64. The offset mixing orifices 68 may introduce the portion of compressed air with a tangential component of velocity (not shown). A mixing nozzle 72 may be positioned downstream from the vortex generator tabs 64 and upstream from the first cylinder 46.

Figure 5:
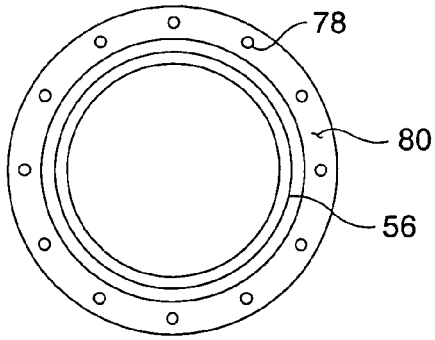
FIG. 5 is a sectional view of the fuel mixing combustion system through line 5—5 of FIG. 2.

The fuel supply line 28 feeds fuel to a fuel nozzle 73 positioned at an entrance portion 74 of the mixing conduit 32. The fuel supply 28 line also feeds a pilot mass of fuel (not shown) to a fuel gallery 76. As shown in FIG. 5, the pilot mass of fuel may exit the fuel gallery 76 through an array of pilot fuel supply orifices 78 positioned in a slot 80 concentric with and radially disposed from the second cylinder 56. The pilot fuel supply orifices 78 may be offset from a plane (not shown) perpendicular to the central axis 48 wherein the offset creates a rotational component of velocity (not shown) for the mass of pilot fuel exiting the slot 80 with respect to the central axis 48. The fuel nozzle 73 may include a conventional liquid fuel nozzle 84, a conventional gaseous fuel nozzle/spoke 86, or both.

INDUSTRIAL APPLICABILITY

The present combustion system 14 provides a low-cost method of achieving jet combustion to reduce emissions of NOx and other regulated emissions. The jet combustion also provides lower incidents of combustion oscillation found in current lean, pre-mixed combustion systems. By using the first array of orifices 54 and second array of orifices 62, small particles are not as likely to block the mixture of fuel and air from flowing through the fuel burner 26.

Operation of the combustion system 14 involves introducing the fuel through the fuel nozzle 73 into the mixing conduit 32. The liquid fuel nozzle 84 may atomize the fuel using one of numerous techniques such as air blast atomization. As the fuel moves through the mixing conduit 32, compressed air from the compressor section 12 is introduced through the array of mixing orifices 66 creating a swirling motion (not shown). Fuel becomes entrained in the swirling compressed air creating a mixture of fuel and air. The vortex generator tabs 64 and vortex energizing slots 70 may further increase homogeneity of the mixture of fuel and air. Increasing the homogeneity reduces localized hot spots when the mixture of fuel and air combusts. These hot spots often result in formation of NOx emissions. The mixing nozzle 72 accelerates the mixture of fuel and air as it passes into the fuel burner 26. During the acceleration, the fuel and air mixture also experiences a drop in pressure.

Upon entering the fuel burner 26, the mixture of fuel and air passes through the first array of orifices 54 of the first cylinder 46. The circulating device 55 circulates the mixture of fuel and air that passes through the first cylinder 46 to the second end portion 52 of the first cylinder 46. The orifice 57 of the circulating device 55 allows a portion of the mixture of fuel and air to pass through and cool the second end portion 60 of the second cylinder 56. The circulating device 55 may also reduce stagnation of the mixture of fuel and air near the second end portion 52 of the first cylinder 46. The mixture of fuel and air may lose a majority of its pressure in relation to an initial pressure at the entrance portion 74 of the mixing conduit 32.

Making the first array of orifices 54 offset from the second array of orifices 62 allows all of the mixture of fuel and air passing through the first array of orifices 54 to perpendicularly impact the inside of the second cylinder 56 with turbulent jets of the mixture of fuel and air. The gap 61 between the first cylinder 46 and second cylinder 56 sets up turbulence to allow substantially all of the mixture of fuel and air to further mix. The gap 61 may be sized such that after impacting the second cylinder 56 the mixture of fuel and air attain sufficient temperature and energy to both maintain stable combustion as the mixture enters the combustion zone 24. Furthermore, the turbulent jets impacting the inside of the second cylinder 56 and the turbulence in the gap 61 of the mixture of fuel and air increase the cooling of the second cylinder.

Pressure in the gap 61 eventually drives the mixture of fuel and air through the second array of orifices 62. The mixture of fuel and air exits the gap 61 as highly mixed, pre-heated jets or plumes of the mixture of fuel and air. The pilot fuel issuing from the slot 80 forms a rich combustion mixture for maintaining flame stability. The rotational component of velocity may further enhance stability by creating a toroidal, diffusion flame (not shown) about the first end portion 58 of the second cylinder 56. In addition, the solid portion 59 between the second array of orifices 62 creates multiple independent ignition points and multiple recirculation regions (not shown) both of which promote stable combustion throughout the combustion zone 24.

It will be apparent to those skilled in the art that various modifications and variations can be made in the disclosed fuel burner for a gas turbine engine without departing from the scope or spirit of the invention. Other embodiments of the invention will be apparent to those skilled in the art from consideration of the specification and practice of the invention disclosed herein. It is intended that the specification and examples be considered as exemplary only.

What is claimed is:

1. A fuel burner for a gas turbine engine disposed about a central axis, said fuel burner comprising:

a first cylinder having a first upstream open end portion and a second downstream closed end portion, said first cylinder having first array of orifices disposed between said first end portion and said second end portion, said first cylinder being disposed about said central axis; and a second cylinder having a first end portion and a second closed end portion, substantially parallel to the closed end of said first cylinder, said second cylinder having a second array of orifices disposed between said first end portion and said second end portion, said second cylinder being coaxial with said first cylinder, said first cylinder being disposed between said second cylinder and said central axis, said first array of orifices being offset axially and/or tangentially from said second array of orifices.

2. The fuel burner of claim 1 wherein said first array of orifices have a smaller diameter than said second array of orifices.

3. The fuel burner of claim 1 wherein said first array of orifices have diameters varying as a function of an axial position along said central axis.

4. The fuel burner of claim 3 wherein said function increases said diameters as said axial position moves along said central axis.

5. The fuel burner of claim 1 wherein a gap between said first cylinder and said second cylinder changes along said central axis.

6. The fuel burner of claim 1 including a mixing conduit having an entrance portion, said mixing conduit being connected with said first end portion of said first cylinder distal from said entrance portion.

7. The fuel burner of claim 6 including a fuel supply line positioned proximate said entrance portion of said mixing conduit.

8. The fuel burner of claim 7 including a plurality of vortex generator tabs intermediate said fuel supply tube and said first end portion of said first cylinder.

9. The fuel burner of claim 7 including a second fuel supply line being positioned adjacent said first end portion of said second cylinder, said second cylinder being disposed between said second fuel supply line and said first cylinder.

10. The fuel burner of claim 1 including a circulating device positioned in the first cylinder to circulate the mixture of fuel and air.

11. A method of burning a fuel in a gas turbine engine, comprising:

supplying a mixture of fuel and air to a first cylinder having an upstream open end and a downstream closed end;

flowing said mixture of fuel and air through a first array of orifices in said first cylinder;

reducing a pressure of said mixture of fuel and air;

impinging a second cylinder positioned radially outward said first cylinder with said mixture of fuel and air; said second cylinder having a closed end substantially parallel to said closed end of said first cylinder;

transferring heat from said second cylinder to said mixture of fuel and air during said impinging;

mixing further said mixture of fuel and air after said transferring;

passing said mixture of fuel and air through a second array of orifices in said second cylinder; said second array of orifices being axially and/or tangentially offset from said first array orifices; and igniting said mixture of fuel and air.

12. The method of burning fuel of claim 11 wherein said further mixing includes increasing turbulent mixing in a gap between said first cylinder and said second cylinder.

13. The method of burning fuel of claim 11 wherein said mixture of fuel and air impinging said second cylinder substantially perpendicular.

14. The method of burning fuel of claim 11 wherein said igniting step is supplying a diffusion flame to said mixture of fuel and air.

15. The method of burning fuel of claim 14 wherein a majority of a pressure reduction occurs through the first array of orifices.

16. A combustion system for a gas turbine engine, said combustion system comprising:

a combustor liner;

a first cylinder having an upstream open end and a downstream closed end, and positioned inside the combustor liner;

a second closed end cylinder positioned between said first cylinder and said combustion liner, said second cylinder being coaxial with said first cylinder, and the closed end of said second cylinder being substantially parallel to the close end of said first cylinder;

a first array of orifices disposed through said first cylinder;

a second array of orifices disposed through said second cylinder, said second array of orifices being substantially axially and/or tangentially offset from said first array of orifices;

a mixing conduit fluidly connecting with said first cylinder; and a fuel supply conduit positioned proximate an entrance portion of said mixing conduit.

17. The combustion system of claim 16 including a fluid mixing means for mixing the fuel and air in said mixing conduit.

18. The combustion system of claim 17 wherein said mixing means includes vortex generator tabs.

19. The combustion system of claim 16 including a slot adjacent a first end portion of said second cylinder, said slot containing a plurality of fuel supply orifices, said pilot fuel supply orifices being connected with a fuel gallery.

20. The combustion system of claim 16 including a circulating device positioned proximate a second end portion of said second cylinder.

* * * * *